United States Patent [19]

Burnett

[11] 4,276,582

[45] Jun. 30, 1981

[54] KEY WITH LIGHT

[75] Inventor: John Burnett, Irvine, Calif.

[73] Assignee: Lock Light Corporation, Laguna Beach, Calif.

[21] Appl. No.: 972,983

[22] Filed: Dec. 26, 1978

[51] Int. Cl.[3] ..... F21V 33/00

[52] U.S. Cl. ..... 362/116; 70/456 B

[58] Field of Search ..... 362/104, 116; 70/456 R, 70/456 B, 459

[56] References Cited

U.S. PATENT DOCUMENTS

| | | | |
|---|---|---|---|
| 807,402 | 12/1905 | Scanlan | 362/116 X |
| 3,085,149 | 4/1963 | Giwosky | 362/116 |
| 3,137,157 | 6/1964 | Ralton | 70/456 R |
| 3,310,668 | 3/1967 | Schwartz | 362/116 |
| 3,313,135 | 4/1967 | Reisner | 70/459 X |
| 3,349,589 | 10/1967 | Fricke | 70/456 R X |
| 3,613,414 | 10/1971 | Ostrager | 362/116 X |
| 3,797,291 | 3/1974 | Simorghi | 70/456 R X |
| 4,085,315 | 3/1978 | Wolter et al. | 362/116 |

*Primary Examiner*—Peter A. Nelson

*Attorney, Agent, or Firm*—Jackson, Jones & Price

[57] ABSTRACT

A key incorporating a miniature light source in a handle thereof, is disclosed. A key body member comprises a substantially elongated first portion and a second portion disposed in an angular relationship to the first portion. The handle of the key comprises a retainer member which incorporates a channel adapted for slidably receiving and retaining the second portion of the key body member. A locking member, comprising a part of the handle, is adapted for interfacing with the retainer member and for removable attachment thereto. A tab protruding from the locking member is disposed adjacent to an opening of the channel thereby locking the key body member into the assembled structure. A suitable cavity is provided within the handle member for operative mounting of a miniature power source, a miniature light bulb and a pressure actuated switch.

18 Claims, 3 Drawing Figures

KEY WITH LIGHT

BACKGROUND OF THE INVENTION

1. Field of the Invention

The present invention relates to a self-illuminating key, and more particularly to a self-illuminating key having a two-piece handle member containing a miniature light and adapted for removable attachment to a key body.

2. Brief Description of the Prior Art

Miniature light sources adapted for use in association with a key or a key ring are well known in the prior art.

U.S. Pat. No. 3,085,149 discloses a miniature light source comprising a housing which incorporates a miniature power cell, a miniature light bulb and a suitable pressure actuated switch.

The housing can be mounted on adaptors for a number of devices such as key blanks, key chains and the like. The mounting is accomplished by means of a threaded flange and a matchingly threaded retaining ring incorporated in the housing.

U.S. Pat. No. 3,310,668 discloses a casing adapted to receive a cartridge unit which incorporates a disc shaped battery, a light bulb and a pressure actuated switch. A key handle is attached to the casing by a screw inserted into an opening provided in the casing.

In the devices described by U.S. Pat. Nos. 3,085,149 and 3,310,668 the miniature light bulb is disposed in substantial axial alignment with a key body so that light emanating from the bulb is principally projected upon a keyhole into which the key is inserted.

While the above described and other prior art devices alleviate the problem and inconvenience encountered by a person who is attempting to insert a key into a key hole in a dark environment, such devices do not provide the self-illuminating key with improved utilitarian and aesthetic features of the present invention.

OBJECTS AND SUMMARY OF THE INVENTION

Accordingly it is an object of the present invention to provide a self-illuminating key which is of a simple construction and therefore inexpensive to manufacture.

It is another object of the present invention to provide a self-illuminating key wherein a power cell is readily replaceable.

It is still another object of the present invention to provide a self-illuminating key which is adapted for receiving a plurality of key blanks.

It is yet another object of the present invention to provide a self-illuminating key wherein a key-handle member is comparable in size to a regular key handle-member and effectively simulates the appearance of the same.

These and other objects and advantages are attained by a key having a key body and a two-piece key-handle member. The key body has a first portion adapted for interfacing with a lock and a second portion disposed in an angular relationship to the first portion. A first piece of the handle member incorporates a channel having an opening to a peripheral edge of the first piece. The channel is dimensioned to slidingly receive and retain at least a part of the second portion of the key body. A second piece of the handle member is adapted to interface with the first piece and to be attached thereto by a plurality of protrusions or studs press fitted into matching, aligned apertures provided on the interfacing surfaces of the first and second handle member pieces. A tab protruding from the second piece is aligned with the opening of the channel and thereby locks the key body within the assembled handle member. A cavity is provided within the handle member to contain a miniature power source, a miniature light bulb, suitable contact plates and a pressure actuated switch.

The objects and features of the present invention are set forth with particularity in the appended claims. The present invention may be best understood by reference to the following description, taken in connection with the accompanying drawings in which like numerals indicate like parts.

DESCRIPTION OF THE PREFERRED EMBODIMENT

Figures 1, 2, 3:
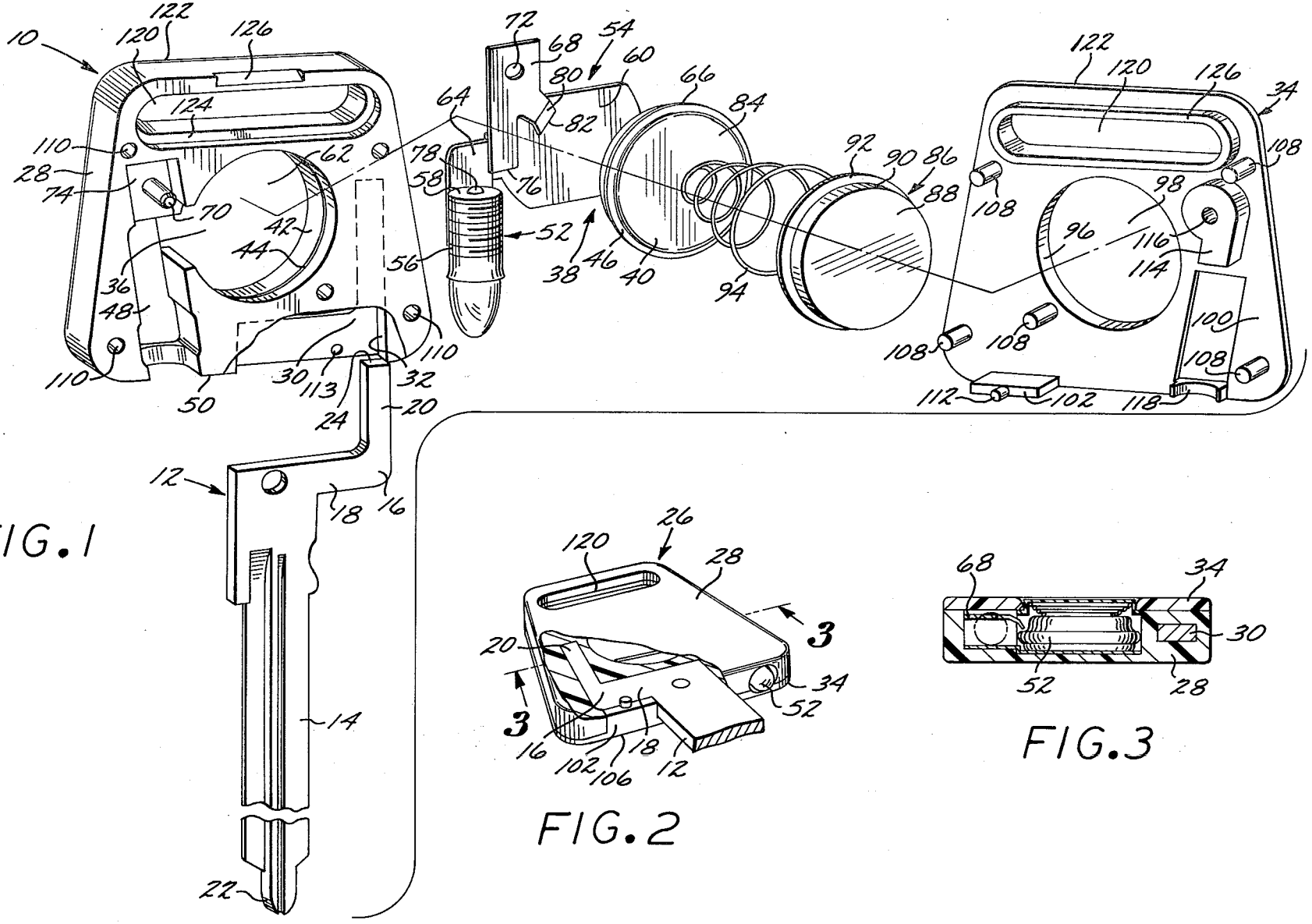
FIG. 1 is an exploded perspective view of the preferred embodiment of the present invention with a part of a handle member broken away.
FIG. 2 is a partial perspective view of the preferred embodiment of the present invention with a part of the handle member broken away.
FIG. 3 is a cross sectional view of the preferred embodiment of the present invention, the cross section being taken at lines 3—3 of FIG. 2.

The following specification taken in conjunction with the drawings sets forth the preferred embodiment of the present invention. The embodiment of the invention disclosed herein is the best mode contemplated by the inventors for carrying out their invention in a commercial environment, although it should be understood that various modifications can be accomplished within the parameters of the present invention.

Referring now to FIGS. 1–3 and particularly to the exploded perspective view of FIG. 1, the preferred embodiment of the present invention is disclosed.

A self-illuminating key 10 includes a key body 12 having a substantially elongated first portion 14 and a second portion 16 which is disposed in an angular relationship to the first portion 14. The first portion 14 may comprise a key blank, as is shown in FIG. 1, which ultimately may be transformed in a locksmith shop or in a suitable key-making machine into a key capable of operating a lock (not shown). Alternatively, prior to assembly into the self-illuminating key 10 of the present invention the first portion 14 of the key body 12 may comprise a fully functional key already capable of operating a lock (not shown).

In the preferred embodiment, the second portion 16 of the key body 12 comprises two sections. A first section 18 is disposed at a right angle to the elongated first portion 14. A second section 20 is disposed at a right angle to the first section 18 and extends from the first section 18 in a direction opposite to the direction of the elongated first portion 14. Thus, the overall length of the key body 12 is defined by the respective ends 22 and 24 of the first portion 14 and of the second section 20. As is readily apparent from the ensuing description, the second portion 16 of the key body 12 is utilized for removable attachment of the key body 12 into a key handle member 26 shown in FIGS. 1–3.

Referring now particularly to FIG. 1, the construction of the handle member 26 is disclosed. The handle member 26 which is composed of suitable plastic material includes a keeper or retainer member 28. The keeper or retainer member 28 has a trapezoidal shape and contains a channel 30 adapted for slidingly receiving and retaining the second portion 16 of the key body 12. Since the second portion 16 includes the first 18 and second sections 20 which comprise an L configuration, the channel 30 is correspondingly formed in an L configuration. It should be remembered that although an L configuration is shown, other suitable configurations are possible and contemplated as within the scope of the invention.

As is best shown in FIG. 2, the key body 12 is inserted into the retainer member 28 with its second portion 24 occupying the channel 30. There the second portion 24 is entirely contained within the walls 32 of the channel 30 and held rather securely by friction. In order to further lock the key body 12 in operative position in the retainer member 28, a locking member 34 is provided. The structure and operation of the locking member 34 is described below.

The retainer member 28 further incorporates a substantially circular well or cavity 36 in substantially the center thereof. The well 36 which is not in communication with the channel 30 serves for mounting of a miniature light source 38 and other necessary appendages described below.

The well 36 is appropriately dimensioned in depth and diameter to retain a commercially available, disc type miniature battery or power cell 40, best shown in FIG. 1. A substantially perpendicularly located wall 42 of the well 36 is offset in a lateral direction to provide a circumferential ledge 44 which accomodates a circular rim 46 of the power cell 40.

A second cavity or channel 48, best shown in FIG. 1, is provided in the retainer member 28. The second channel 48 abuts the circumference of the well 36 whereby the well 36 and the second channel 48 are in communication. The second channel 48 also has an opening at the same peripheral edge 50 of the retainer member 28 where channel 30 has an opening.

The second channel 48 is dimensioned to receive and retain by friction a miniature light bulb 52, best shown in FIG. 1. The miniature light bulb 52, utilized in the present invention, is a commercially available lens tipped type bulb. It is in electrical contact with a conductive metal plate 54 through a cylindrically shaped brass terminal 56 provided in the light bulb housing 58. In order to ensure perfect electrical contact and to simplify the assembly of the self-illuminating key 10 of the present invention the terminal is permanently soldered to the metal plate 54.

The metal plate 54 is configured for insertion within the well 36 and within the second channel 48 which is adjacent to the well 36. Consequently it has a main plate 60 which is fitted into the well 38 and supported therein by a bottom wall 62 of the well 38. The metal plate 54 also has a smaller, substantially rectangular plate 64 contiguous to the main plate 60; the rectangular plate is inserted into second channel 48. The light bulb 52 is soldered to this rectangular plate 64. The power cell 40 is disposed in the well above the metal plate 54 with one pole 66 thereof being in permanent electrical contact with the metal plate 54.

In order to complete a circuit between the power cell 40 and light bulb 52 a contact or switch plate 68 is provided. The contact or switch plate 68 is fixedly positioned in the retainer member 28 upon a cylindrical protrusion or stud 70 which engages an appropriately located aperture 72 provided in the switch plate 68. The stud 70 is located in an offset portion 74 of the retainer member 28. The offset portion 74 is adjacent to the second channel 48. A forwardly located edge 76 of the switch plate 68 is in permanent electrical contact with a second terminal 78 of the light bulb 52.

The switch plate 68 has a laterally extending protruding portion or ear 80. The ear 80 is bent so that it occupies an obtuse angular position relative to a plane generally defined by the switch plate 68. The configuration of the switch plate 68 and of the ear 80 is designed in such a manner that in the normal operative position of the switch plate 68 a leading edge 82 of the ear 80 is in close proximity to, but not in contact with the rim 46 provided in the power cell 40. The rim 46 comprises a part of a second pole 84 of the power cell 40.

A disc 86 composed of electrically insulating plastic material is provided for mounting within the assembled retainer 28 and locking members 34. The disc 86 has a circular main plate 88, a relatively short peripheral ear 90 disposed perpendicularly to the main plate 88 and a circumferential flange 92 disposed orthogonally to the ear 90. A coil spring 94 engaged by the peripheral ear 90 is disposed between the power cell 40 and the disc 86. The disc 86, in turn, is held in operative position by the peripheral flange 92 which engages an edge 96 of a circular aperture 98 in the locking member 34.

As is readily apparent from the above description, the coil spring 94 biases the disc 86 preventing it from exerting pressure on the switch plate 68. However when the disc 86 is depressed by a user of the self-illuminating key 10 of the present invention, the peripheral flange 92 engages the ear 80 of the switch plate 68 and moves it into contact with the rim 46 of the power cell 40 thereby completing the electrical circuit and energizing the light bulb 52. The electrical circuit stays closed as long as the disc 86 is depressed.

The locking member 34, best shown in FIG. 1, comprises a plate corresponding in shape substantially to the trapezoidal shape of the retainer member 28. The circular aperture 98 which penetrates through the entire body of the locking member 34 is located substantially in the center thereof. The entire inner surface 100 of the locking member is designed to interface with the retainer member 28.

The locking member 34 incorporates a protrusion or tab 102 located adjacent to an edge 10 thereof. The tab 102 disposed substantially perpendicularly to the plane generally defined by the locking member 34, is positioned to cover the opening of the channel 30 in which the second portion 16 of the key body 12 is contained. A suitable notch 106, shown in FIG. 2, is provided in the body of the retainer member 28 to accomodate the tab 102 in the assembled structure. As is readily apparent from the above description the tab 102 locks the key body 12 in the channel 30.

Reversible fastening of the retainer 28 and locking members 34 to one another is accomplished by press fitting a plurality of cylindrical protrusions or studs 108 into matching apertures 110.

As is shown in FIG. 1 the studs 108 are provided on the inner surface 100 of the locking member 34 with one additional stud 112 being located on the tab 102. The matching, aligned apertures 110 are located on the retainer member 28. The particular spatial configuration of the studs 108 and of the aligned apertures 110 embodied in the herein described preferred embodiment can be readily varied without departing from the spirit of the present invention. Therefore such apparent alternatives as, for example, placing the studs in the retainer member 28 and the apertures in the locking member 34 are included within the scope of the present invention. The stud 112 on tab 102 engages the aperture 113 in the retainer member 28.

The locking member 34 further includes a protrusion 114 configured in the shape of the Arabic numeral nine. The purpose of this protrusion 114 is to prevent disengagement of the switch plate 68 from contact with the second terminal 78 of the light bulb 52. An aperture 116 provided in the protrusion 114 is aligned with the stud 70 to accomodate the same.

A curved projection 118 located in the vicinity of the edge 104 in the locking member 34 is adapted to embrace the housing 58 of the light bulb 52 in the assembled structure thereby further securing it in operating position.

Both the retainer 28 and locking members 34 include an elongated slot 120 disposed parallel with the shortest edge 122 of the respective trapezoid shaped members 28 and 34. The periphery of the slot 120 provided in the retainer member 28 includes a ledge 124 and the locking member 34 incorporates a ridge 126 adapted for mating with the ledge 124 in the assembled structure. The slot may be utilized for mounting the self-illuminating key 10 of the present invention upon a key ring or like object (not shown).

As it is readily apparent from the above description the self-illuminating key of the present invention is easily assembled even by a person of very meager mechanical skills. Therefore a user may readily remove or insert the key body 12 or change the power cell 52 when the need arises. The ability to easily remove and reattach the key body 12 is especially helpful, when in the process of manufacturing a copy of the key body 12, it needs to be securely held in a vise (not shown) of a suitable key-copying device (not shown).

A groove 126 facilitating the disengagement of the locking member 34 from the retainer member 28 is provided on the edge 120 of the retainer member 28. The groove 126 enables a user to initiate the disengagement process by inserting a sharp object (not shown) between the retainer 28 and locking members 34.

What has been described above is a self-illuminating key incorporating novel means for locking a key body within a key handle member. It will be apparent to those skilled in the art that various modifications of the present invention are possible and accordingly the scope of the present invention should be interpreted solely from the following claims.

I claim:

1. A key apparatus comprising:

a first handle member having at least one peripheral side edge and a cavity with an opening into the peripheral side edge;

a key body including a substantially elongated first portion and a second portion contiguous to the first portion, the second portion extending from the first portion in a direction having a directional component other than the general longitudinal axis of the first portion, the second portion dimensioned to be slideably fitted into the cavity;

a second handle member having a surface dimenioned to be juxtaposed to and interface with a surface of the first handle member, the second handle member also having a peripheral side edge and at least one protrusion on the peripheral side edge said protrusion being adapted to at least partially cover the opening of the cavity whereby the key body member is securely locked in the cavity, the protrusion preventing the key body member from sliding out of the cavity, and means for physically attaching the interfacing first and second handle members.

2. The invention of claim 1 wherein the physically attaching means comprise at least one additional protrusion provided in one of the interfacing surfaces of the first and second handle members and an aperture matching the additional protrusion in the interfacing surface of the other handle member not having the additional protrusion, the additional protrusion being press fittable into the aperture.

3. The invention of claim 2 wherein the second portion of the key body member comprises two sections disposed at a right angle to one another, one of the two sections being disposed at a right angle to the first portion and being juxtaposed to the protrusion provided in the second handle member which covers the opening of the cavity.

4. The invention of claim 2 further comprising an electric power source, a miniature light bulb, electric contact means and switch means for selectively energizing the light bulb.

5. The invention of claim 4 wherein the first handle member incorporates a second cavity containing the power source and a third cavity incorporating the miniature light bulb.

6. A key apparatus comprising:

a key body having at least a first and second portion, the first and second portions being disposed in an angular relationship to one another;

a substantially flat keeper member having at least one channel dimensioned to slideably receive the second portion of the key body through an entrance to the channel, said entrance to the channel being located on an edge of the keeper member, the edge comprising a rim of the substantially flat keeper member;

a substantially flat locking member adapted to be attached to and to interface with the keeper member, the attached keeper member and locking members comprising a key handle, the locking member having at least one member protruding from the locking member and unitarily constructed therewith for disposition on an edge of the substantially flat locking member, the edge of the locking member comprising a rim of the substantially flat locking member, the protruding member at least partially covering the entrance to the channel thereby preventing a removal of the second portion of the key body from the channel and locking the same therein.

7. The invention of claim 6 further comprising a miniature light bulb, a power cell, contact means and switch means for selectively energizing the light bulb.

8. The invention of claim 7 wherein the keeper member contains a cavity, and the cavity has a first portion dimensioned to retain the power cell and a second portion dimensioned to retain the miniature light bulb.

9. The invention of claim 8 wherein the power cell is substantially disc shaped and wherein the contact means comprise a first conductive plate retained within the cavity and being in permanent electrical contact with a first pole of the power cell and with a first lead terminal of the light bulb, said contact means further comprising a second conductive plate in permanent electrical contact with a second lead terminal of the light bulb, and wherein the switch means comprise means for exerting pressure on the second plate to come into electrical contact with a second pole of the power cell thereby completing a circuit and energizing the light bulb.

10. The invention of claim 9 wherein the locking member includes an aperture positioned substantially above the power cell, and wherein the switch means comprise a disc having a peripheral flange retained in the aperture and a spring positioned between the disc and the power cell biasing the disc thereby preventing the flange from exerting pressure on the second conductive plate.

11. The invention of claim 10 wherein the attachment of the keeper member to the locking member is by press fitting a plurality of protrusions into matching apertures, the protrusions and matching apertures being located on interfacing surfaces of the keeper and locker members.

12. The invention of claim 11 wherein the member protruding from the locking member comprises a tab having a plane substantially perpendicular to a plane generally defined by the locking member.

13. A self-illuminating key comprising: a key body having a first portion adapted for insertion into a lock and a second portion unitarily constructed with the first portion and having a nonlinear spatial relationship thereto;

an electrically non-conductive retainer member having a hollow space therein to retain a miniature electric battery and a miniature light bulb, the retainer member also having a channel dimensioned to slideably receive and retain at least a part of the second portion of the key body said channel having an entrance on a peripheral edge of the retainer member;

an electrically non-conductive locking member adapted to interface with and be attached to the retainer member, the attached retainer and locking members comprising a key-handle member, the locking member having a substantially circular aperture penetrating through the locking member and a tab integrally constructed therewith and located on a peripheral edge of the locking member, the tab being disposed angularly relative to a plane generally defined by the locking member, the tab being dimensioned and disposed to block the entrance to the channel in the retainer member whereby the second portion of the key body is unable to slide out of the channel and whereby the key body is locked in the assembled key-handle member, and contact means and switch means to selectively supply power to the electric light bulb, the switch means comprising a member disposed between the retainer member and the locking member, the member capable of being actuated through the substantially circular aperture in the locking member.

14. The invention of claim 13 wherein a plurality of studs and matching apertures are incorporated in the interfacing surfaces of the retainer and locking members, the studs being press fitted into the apertures whereby the retainer and locking members are fixedly but removably attached to one another.

15. The invention of claim 14 wherein the second portion of the key body comprises a first section disposed at a right angle to the first portion and contiguous thereto and a second section being disposed at a right angle to the first section, the first section being adjacent to the tab in the assembled self-illuminating key and being restricted in movement by the tab.

16. The invention of claim 15 wherein the retainer and locking members are composed of plastic material.

17. The invention of claim 15 wherein the retainer and locking members incorporate means for mounting the self-illuminating key to a key ring.

18. The invention of claim 15 wherein the light bulb is axially aligned with the first portion of the key body.

* * * * *